US006056157A

United States Patent [19]

Gehl et al.

[11] Patent Number: 6,056,157

[45] Date of Patent: May 2, 2000

[54] DEVICE FOR DISPENSING FLOWABLE MATERIAL FROM A FLEXIBLE PACKAGE

[75] Inventors: John P. Gehl, Hartland; Carol J. Nikolaus; Tim Freeman, both of Shorewood; David A. Borsheim, Sussex; Arnold A. Jahn, Menomonee Falls, all of Wis.

[73] Assignee: Gehl's Guernsey Farms, Inc., Germantown, Wis.

[21] Appl. No.: 08/625,210

[22] Filed: Apr. 1, 1996

Related U.S. Application Data

[63] Continuation-in-part of application No. 08/603,706, Feb. 20, 1996, abandoned, which is a continuation of application No. 08/441,722, Mar. 28, 1995, abandoned, which is a continuation of application No. 08/212,899, Mar. 14, 1994, abandoned.

[51] Int. Cl.[7] ..... B65D 35/22

[52] U.S. Cl. ..... 222/94; 222/105; 222/131; 222/146.5; 222/185.1; 222/518

[58] Field of Search ..... 222/94, 105, 131, 222/146.5, 146.6, 181.1, 185.1, 505, 509, 518, 1, 516, 513; 251/309, 310, 144, 245

[56] References Cited

U.S. PATENT DOCUMENTS

| | | | |
|---|---|---|---|
| D. 328,220 | 7/1992 | Barnard et al. . | |
| 2,274,409 | 2/1942 | Harbison | 222/183 |
| 2,777,304 | 1/1957 | Nave | 222/146.6 X |
| 2,781,153 | 2/1957 | Roberts | 222/146.6 X |
| 2,872,078 | 2/1959 | Kennedy | 222/131 |
| 3,002,659 | 10/1961 | Woodis | 222/131 X |
| 3,042,265 | 7/1962 | Rodth | 222/131 X |
| 3,139,219 | 6/1964 | Gran | 222/131 |
| 3,285,474 | 11/1966 | Gran | 222/131 |
| 3,435,990 | 4/1969 | Pike, Jr. | 222/183 X |
| 3,811,294 | 5/1974 | Taylor | 222/146.6 X |
| 3,815,871 | 6/1974 | Carlson | 251/310 |

(List continued on next page.)

OTHER PUBLICATIONS

Liqui–Box Announces . . . Liqui–Box Corporation (publication date unknown).

Liqui–Box Leading with Imagination in Totally Integrated Packaging Systems; Liqui–Box Corp, 1989.

Liqui–Box Pacessetter 2000 Series Modular Fillers for Bag–In–Box packaging; Liqui–Box Corp., 1989.

Flurry Topping Food Dispensers; Bulletin XOWMDP001; Flurry International Inc., 1990.

*Primary Examiner*—Joseph A. Kaufman
*Attorney, Agent, or Firm*—Michael Best & Friedrich LLP

[57] ABSTRACT

A device for sanitary dispensing from a flexible package a heated flowable material, such as cheese sauce, to be maintained at or above a predetermined temperature level after the package is opened. The dispensing device includes a housing defining heated compartment, a heating unit for maintaining the compartment at or above the predetermined temperature level, a package support in the compartment arranged to promote gravity flow of the material and a valve for selectively controlling flow of the material from the package and having a dispensing portion disposed substantially entirely in the compartment or the package support. The valve is removably connected to a package outlet and a valve member mounted in a valve body is moved from a closed position to an open position by an operator to discharge cheese sauce through a discharge opening in the housing. A second package of cheese sauce preferably is placed on top of the dispensing package to serve as a weight for promoting gravity flow from the dispensing package and to precondition the second package. In one embodiment, the package support is divided into a dispensing compartment and a preheating compartment which is arranged to hold a package in a configuration which permits the cheese sauce to be heated to an elevated temperature required by ANSI/NSF standards. The package support preferably is a one piece hopper molded from a synthetic thermoplastic or thermosetting material and packages in the dispensing and preheating compartments are heated by electrical heating elements molded into the hopper walls.

4 Claims, 8 Drawing Sheets

U.S. PATENT DOCUMENTS

| | | | |
|---|---|---|---|
| 4,228,925 | 10/1980 | Mendelovich | 222/103 |
| 4,373,647 | 2/1983 | Hollingsworth | 222/105 X |
| 4,513,885 | 4/1985 | Hogan | 222/95 |
| 4,690,307 | 9/1987 | Hogan | 222/95 |
| 4,756,450 | 7/1988 | Negaty-Hindi et al. | 222/95 |
| 4,775,564 | 10/1988 | Shriver et al. | 428/35 |
| 4,796,788 | 1/1989 | Bond | 222/94 |
| 4,804,118 | 2/1989 | Mullen et al. | 222/146.6 X |
| 4,854,545 | 8/1989 | Pezzarossi | 251/310 |
| 4,913,713 | 4/1990 | Bender | 222/146.6 X |
| 4,930,666 | 6/1990 | Rudick | 222/146.6 X |
| 4,991,742 | 2/1991 | Chang | 222/95 |
| 5,069,364 | 12/1991 | McGill | 222/95 |
| 5,102,015 | 4/1992 | Barnard et al. | 222/135 |
| 5,186,359 | 2/1993 | Brown et al. | 222/1 |
| 5,301,601 | 4/1994 | Cretors | 222/146.5 X |

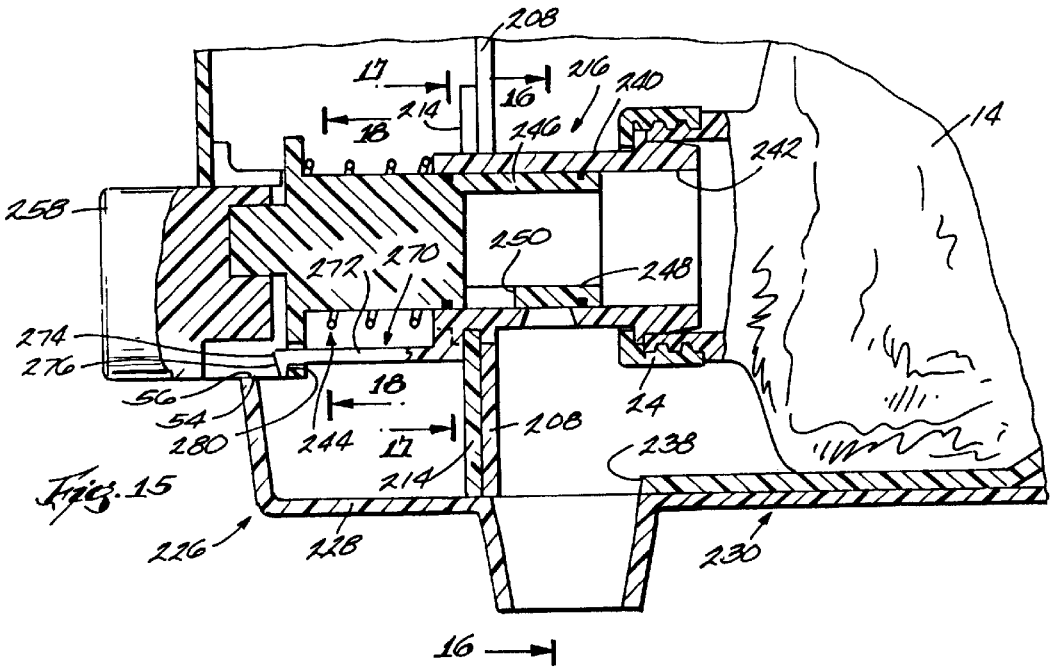
Fig. 15
Fig. 17
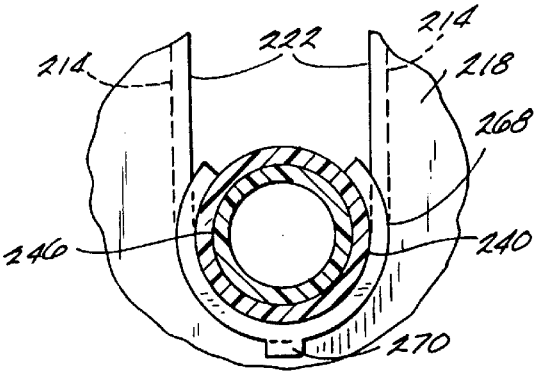
Fig. 18
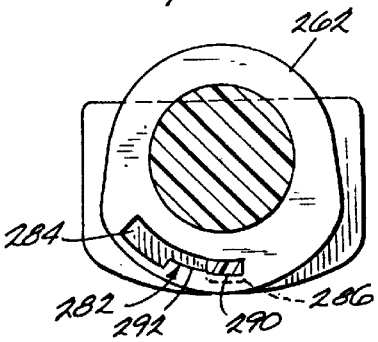
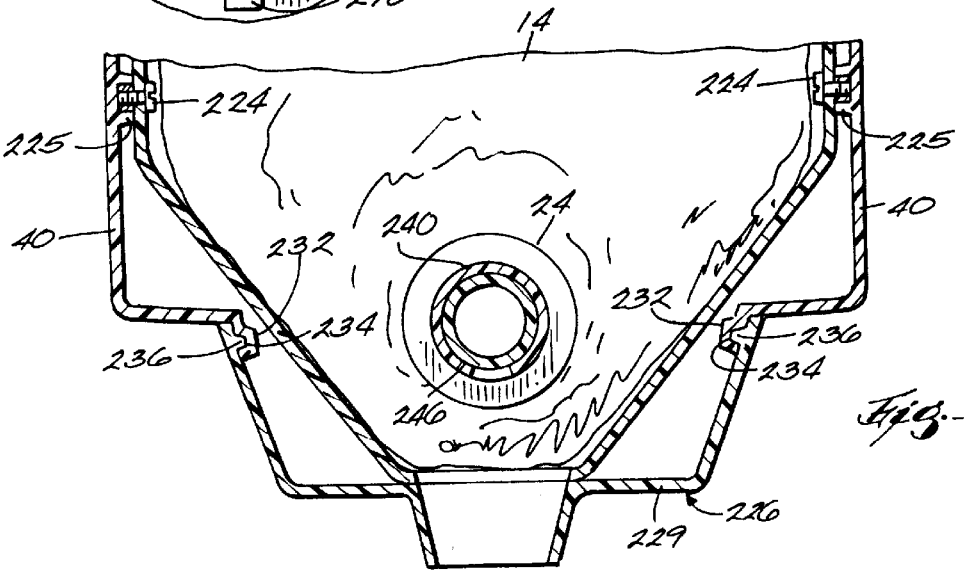
Fig. 16

DEVICE FOR DISPENSING FLOWABLE MATERIAL FROM A FLEXIBLE PACKAGE

RELATED APPLICATION

This application is a continuation-in-part of application Ser. No. 08/603,706, filed Feb. 20, 1996, now abandoned which is a continuation of application Ser. No. 08/441,722, filed Mar. 28, 1995, now abandoned which is a continuation of application Ser. No. 08/212,899, filed Mar. 14, 1994 now abandoned.

BACKGROUND OF THE INVENTION

1. Field of the Invention

The invention relates to devices for dispensing heated flowable materials from containers and, more particularly, to devices for dispensing heated flowable materials such as food products from flexible packages.

2. Reference to Prior Art

It is common practice to dispense cheese sauce, catsup, mustard and other flowable food products from a can or other similar container with a pump-like dispenser. In order to prevent bacterial growth in low acid food products, such as cheese sauce, those products must be maintained at or above an elevated temperature, e.g. 140° F., after the can or container is opened.

One type of pump dispenser widely used for low acid products has a water jacket which surrounds a large part of the can or container, and the water is heated to the required temperature. The dispensing nozzle and other parts of the dispensing device must be cleaned at regular intervals, for example, at the end of each day. Care must be taken to insure that the water jacket contains a sufficient amount of water to prevent the heating element from burning out. In many cases, a substantial amount of cheese sauce or the like in the bottom of the can or container is not dispensed by the pump. Also, the heated water jacket can cause a considerable build up of condensation on the exterior and inside the dispenser.

Some food products are sold in flexible packages and dispensed from those packages. However, prior dispensers for flexible packages either are quite complicated and, therefore, are substantially more expensive than pump type dispensers described above, or have one or more other shortcomings.

U.S. Barnard et al. U.S. Pat. No. 5,102,015 relates to a dispenser for dispensing fluid food products from bags through nozzles attached thereto. The dispenser includes an actuator plate having V-shaped slots. A push rod carries the actuator plate and positions a selected V-shaped slot adjacent to the selected nozzle. The rod can be pushed to engage a switch and activate a motor which moves the actuator plate so that a V-shaped slot engages a nozzle to dispense the selected fluid.

U.S. Hogan U.S. Pat. Nos. 4,690,307 and 4,513,885 relate to a dispensing system including a housing for storing a sealed flexible package containing a flowable food product and compressible flow tube connected to a discharge fitment on the package. Manual operation of a rotor or peristatic pump in the housing compresses the tube to cause the product to be dispensed from the package.

U.S. Bond U.S. Pat. No. 4,796,788 relates to dispensing substances which will not readily flow by gravity from bag-in-box packages. The bag includes separate product and pressure chambers. Coupling fitments connect independently to the respective chambers. To dispense the product, a dispensing valve on the product fitment is opened and pressure is supplied to the pressure chamber to expand it and exert pressure on the product chamber.

SUMMARY OF THE INVENTION

An object of the invention is to provide a low cost, simply constructed dispenser for selectively dispensing a heated flowable material from a flexible package, and maintaining the material at or above a predetermined temperature after the package is opened.

Another object of the invention is to provide such a dispenser for dispensing food products, such as cheese sauce, which is convenient to operate and maintain and is arranged to maximize the amount of material emptied from the package during normal operation.

Another object of the invention is to provide a dispenser described in the immediately preceding paragraph which is arranged to expedite and simplify replacement of an emptied package.

Another object of the invention is to provide such a dispenser which is capable of meeting NSF standard for both storage of low acid food products in a dispenser and rethermalization.

Another object of the invention is to provide a method for selectively dispensing a flowable food product from a flexible package while maintaining the material and a dispensing valve for controlling the flow of the food product at or above a predetermined temperature.

Other objects, aspects and advantages will become evident to those skilled in the art upon reviewing the following detailed description, drawings and claims.

The invention provides a device for dispensing a heated flowable material from a flexible package and maintaining the material at or above a predetermined temperature level after the package is opened. The device includes a housing defining a storage compartment, a heating unit for maintaining the storage compartment at or above the predetermined temperature, means for supporting the package in the storage compartment at an orientation promoting gravity flow of the material toward and through the package outlet, a valve for selectively controlling flow of the material from the package and a dispensing outlet through which the material is discharged from the compartment. The dispensing portion of the valve is disposed entirely within the storage compartment and includes a valve body, means for removably connecting the valve body to the package outlet, a valve outlet communicable with the flow passage, and a valve member mounted in the valve body for movement between a closed position and an open position wherein the material can flow from the package, through the flow passage and out through the valve outlet. An actuating portion of the valve is operably connected to the valve member for moving the valve member between the closed and open positions.

In one embodiment, the actuating portion of the valve is removably connected to the valve member so that the dispensing portion of the valve can be connected to a package prior to placement in the storage compartment, the dispensing portion and package can be removed as a unit when the package is emptied, and the dispensing portion can be conveniently removed from the empty package and installed on a new package prior to placement in the compartment to facilitate and expedite installation of a replacement package.

In another embodiment, the actuating portion and the valve member are connected together to form a subassembly and the valve body is removably connected to this subassembly and the entire dispensing valve can be connected to a package prior to installation in the package support.

The dispensing valve can be arranged so that the valve member is rotated relative to the valve body to an open position by depressing a knob accessible from the exterior of the housing or is moved axially to an open position by pushing on a knob accessible from the exterior of the housing.

Gravity flow of the material from the package can be promoted by applying a downward force on the dispensing package. A preferred way of accomplishing this is to place a second package of the material which is placed on top of the dispensing package so that the material in the second package is conditioned to the predetermined temperature and the package ready for immediate dispensing when the first package is emptied.

In one embodiment, the package support is in the form of a hopper molded as a one-piece unit from a synthetic thermoplastic or thermosetting material. The heating unit can be a small fan which blows over an electric heater located beneath the package support. When the package support is a hopper, the heating unit can be a plurality of heating elements molded into the hopper walls or electric blankets attached to the exterior or interior surfaces of the hopper walls.

In one embodiment, a partition extending generally parallel to the side walls of the hopper divides it into a dispensing compartment and a preheating compartment. The preheating compartment is arranged to prevent substantial bulging of the package side walls positioned on one edge, thereby maintaining the thickness of the material mass at a dimension which permits the material to be heated to predetermined temperature within a substantially shortened time period than would be the case if the package side walls were allowed to bulge naturally.

The method provided by the invention includes the steps of (a) providing a housing including a heated compartment, (b) supporting a flexible package containing a flowable material at an orientation which promotes gravity flow of the material toward and through the package outlet, (c) maintaining the compartment at or above the predetermined temperature with a heater located inside the compartment, (d) selectively controlling flow of the material from the package with a dispensing valve removably connected to the package outlet and including an actuating portion and a dispensing portion, with at least the dispensing portion disposed inside the heated compartment, (e) maintaining at least the dispensing portion of the dispensing valve at or above the predetermined temperature by heating directly with the heater and (f) dispensing material from the compartment through an opening in the housing. Flow of material from the package preferably is promoted by placing a second flexible package containing the material on top of the package from which the material is being dispensed. This second package is preheated to the predetermined temperature, while material is being dispensed from the first package, and is ready for immediate dispensing after the first package is emptied.

BRIEF DESCRIPTION OF THE DRAWINGS

FIG. 15 is an enlarged, fragmentary and partially sectional view of the dispensing valve installed on the hopper and with the housing lid and valve guard installed.

FIG. 16 is a sectional view taken generally long line 16—16 in FIG. 15.

FIG. 17 is a sectional view taken generally along line 17—17 in FIG. 15.

FIG. 18 is a sectional view taken generally along line 18—18 in FIG. 15.

FIG. 20 is a perspective view of an alternate arrangement for the hopper.

FIG. 21 is an enlarged, sectional view taken generally along line 21—21 in FIG. 20.

DETAILED DESCRIPTION OF A PREFERRED EMBODIMENT

Figure 1:
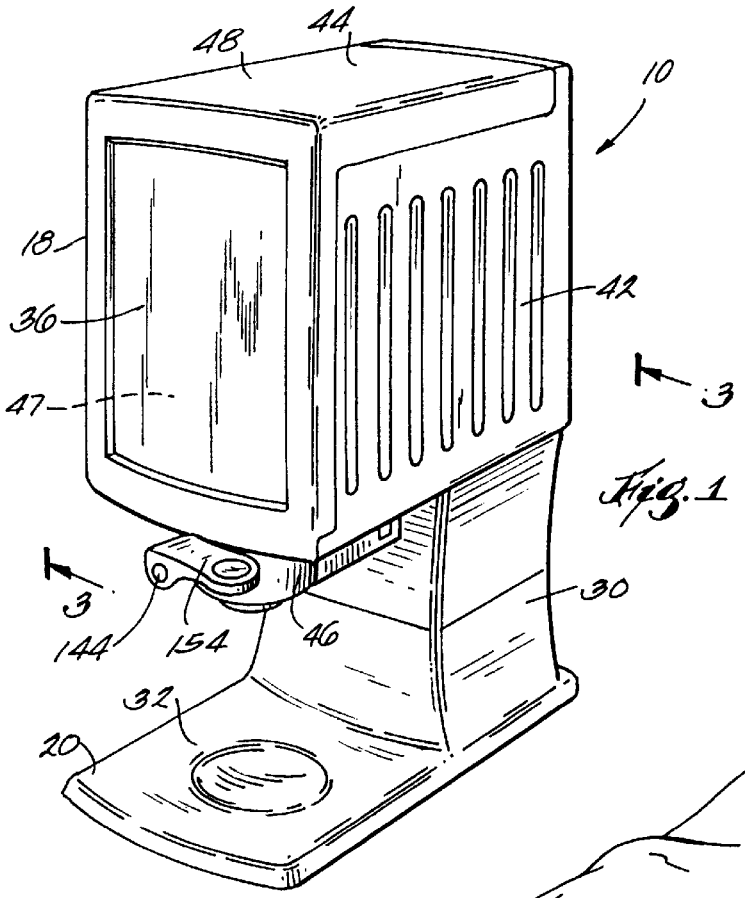
FIG. 1 is a perspective view of a dispensing device of the invention.
Figure 2:
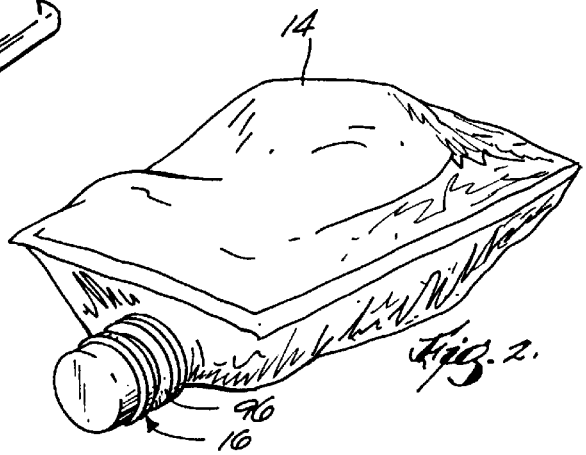
FIG. 2 is a perspective view of a flexible package containing a flowable material, such as cheese sauce, used in the dispenser shown in FIG. 1.

While the dispensing device and method provided by the invention can be used for or in connection with dispensing from a flexible package a wide variety of flowable products which must be maintained at or above a predetermined temperature after the package is initially opened, it is particularly adaptable for dispensing low acid food products, such as cheese sauce, and will be described in connection with such application.

The dispensing device 10 illustrated in the drawings is adapted for sanitary dispensing of cheese sauce 12 from a flexible package 14 having a package outlet 16. The cheese sauce 12 must be maintained at or above 140° F. after the package 14 is initially opened to meet FDA requirements for low acid foods. The dispensing device 10 includes a housing 18 supported on a base 20, a heating unit 22 located inside the housing 18, a support 24 for the package 14 inside the housing 18, a dispensing valve 26 for controlling the flow of cheese sauce from the package 14, and a dispensing outlet 28 in the housing 18.

The base 20 includes a rear pedestal portion 30 supporting the housing 18 and a front tray portion 32 for supporting a container (not shown) into which the cheese sauce 12 is to be dispensed. The housing 18 includes opposed front and rear walls 36 and 38, opposed side walls 40 and 42, and opposed top and bottom walls 44 and 46 cooperating to define a heated compartment 47. A pair of heating unit brackets 50 and 52 extend generally horizontally between the side walls 40 and 42. The top wall 44 and front wall 36 are integrally connected to each other and form a lid 48. The lid 48 is removably mounted relative to the bottom wall 46, rear wall 38 and the side walls 40 and 42. The lid 48 can be removed by lifting the lid 48 relative to the bottom wall 46, rear wall 38 and the side walls 40 and 42. When the lid 48 is removed, a package 14 can be placed into or removed from the compartment 47.

The bottom wall 46 extends forwardly from the pedestal portion 30 and is generally saucer-shaped. The saucer-shaped bottom wall 46 includes an upper edge portion 54 abutting the front wall 36. The bottom wall 46 has an aperture or dispensing outlet 28. The upper edge portion 54 of the bottom wall 46 also has a handle notch 56. The bottom wall 46 also includes an inwardly extending ledge 58 beneath the handle notch 56. The ledge 58 has therein an aperture 62. The bottom wall 46 also includes a pair of spaced, upwardly extending brackets 64 and 66, the function of which will be described below.

The housing 18 and the base 20 preferably are molded from a synthetic thermoplastic or thermosetting plastic material, such as a polycarbonate-polyester blend, to reduce cost and minimize heat loss. Preferably, the housing 18 (except for the lid 48) is molded as a two-piece unit, with the pieces abutting along vertical centerlines.

The flexible package 14 (see FIGS. 2–5) has a package outlet 16. Before being opened, the package outlet 16 is sealed by a removable cap. The package outlet 16 includes male threads for connecting to a female threaded B-nut 94 as described below. Three flanges 96 extend radially outwardly from the package outlet 16. While various conventional flexible packages 14 can be used, so-called bag-in-box type packages supplied by Liqui-Box Corporation (Worthington, Ohio) are preferred because they can be filled and maintained under the aseptic conditions required for dairy and other low acid food products. This type package is disclosed in U.S. Pat. Nos. 3,173,579 and 4,796,788, which are incorporated herein by reference. The box portion of the bag-in-box type package is not required for use with the dispensing device of the invention. Also, the latter patent actually discloses a pressurizable version of a bag-in-box package. As described below, the pressurizable feature is not required for the dispensing device of the invention.

The package support 24 is arranged to promote gravity flow of the cheese sauce 12 toward and through the package outlet 16. While other constructions of the package support 24 are possible, the package support 24 preferably is in the form of a pan 82 having a bottom 80 inclined downwardly toward the housing front wall 36 for supporting the package 14 at an orientation promoting gravity flow of the cheese sauce 12 toward the package outlet 16. The bottom 80 of the pan 82 is supported upon the upper surface 86 of the heating unit housing 84. The pan 82 includes a front wall 98 having an outturned flange 100 which rests on a brace or ledge 102 extending between the side walls 40 and 42.

Figure 3:
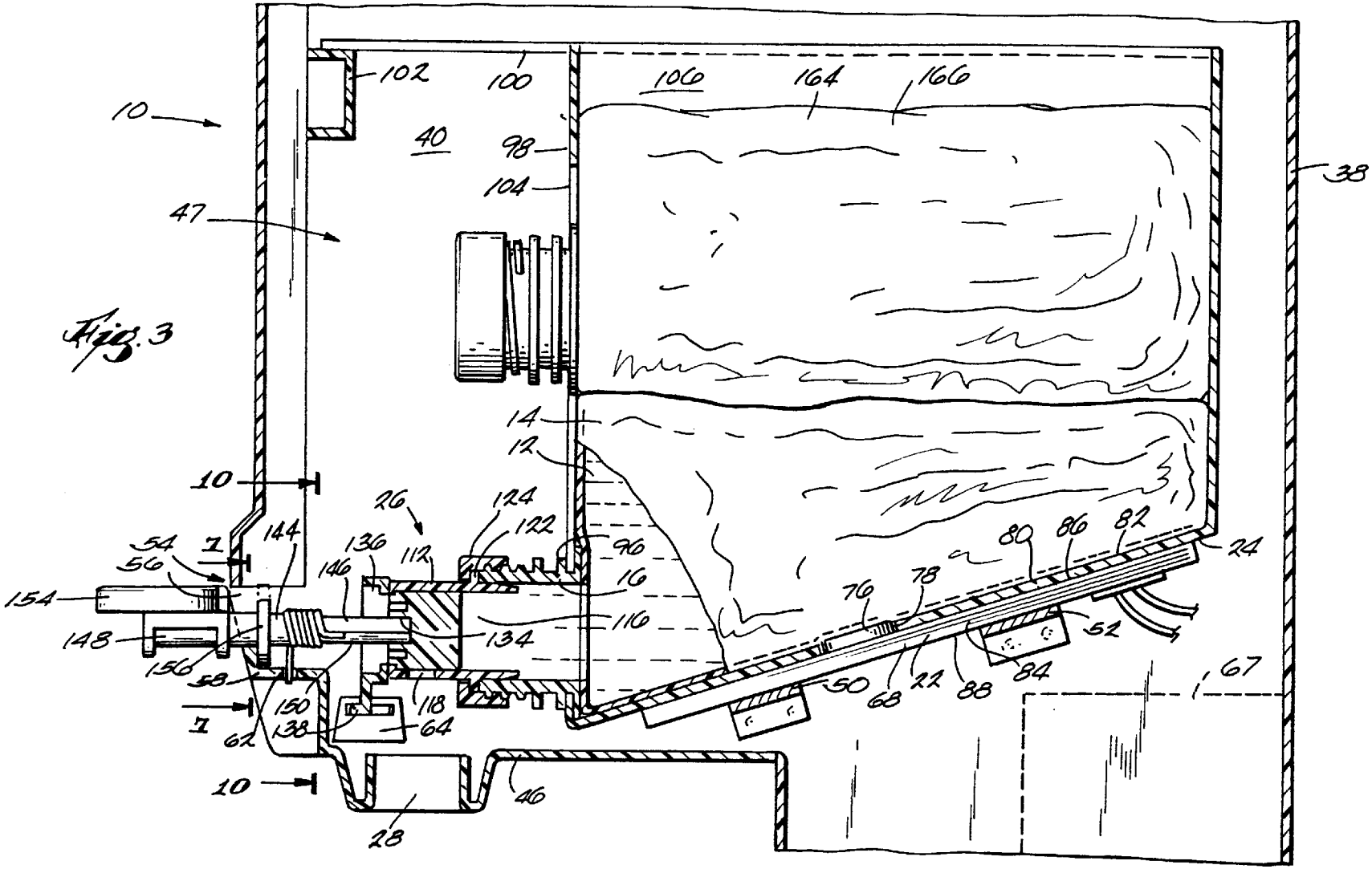
FIG. 3 is an enlarged partial sectional view taken generally along line 3—3 in FIG. 1, with the lid removed and the dispensing valve in the closed position.
Figure 4:
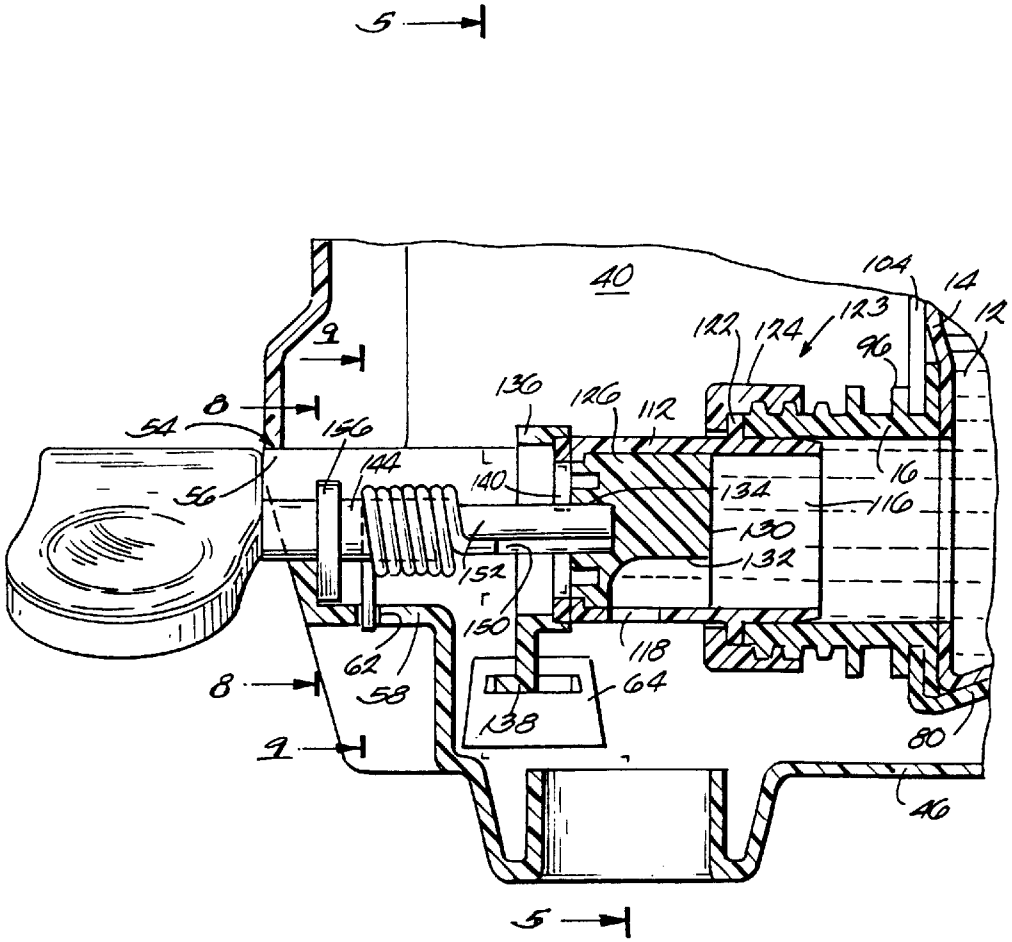
FIG. 4 is an enlarged view of a portion of FIG. 3, with the dispensing valve in the open position.
Figure 5:
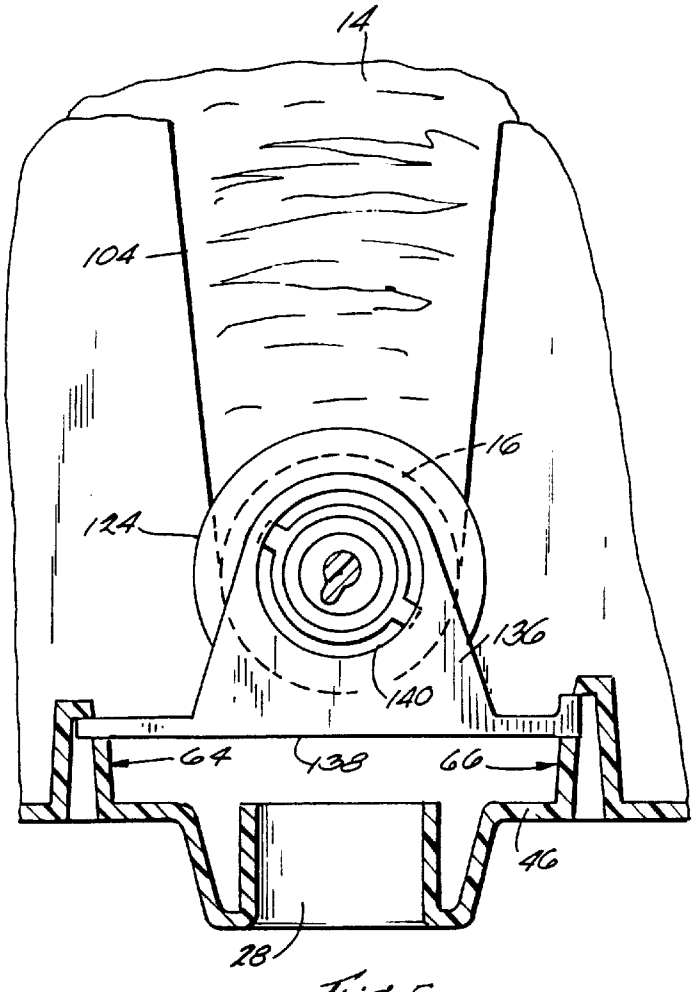
FIG. 5 is a partial sectional view taken generally along line 5—5 in FIG. 4.

As best shown in FIGS. 3–5, the front wall 98 has an elongated slot 104 which receives the package outlet 16. The slot 104 includes opposed lower and upper ends. The width of the slot 104 increases from the lower end to the upper end. The slot 104 at the lower end is sized to receive the package outlet 16 between a pair of the flanges 96, such that the flanges 96 slightly overlap the pan front wall 98. The pan 82 also includes opposed side walls 106. The front wall 98 and side walls 106 are sufficiently high for the pan 82 to receive a second package of cheese sauce atop the package 14. The pan 82 preferably is constructed of heat conducting material such as metal and, more preferably, is constructed of a rust-resistant, heat conducting material such as aluminum or an aluminum alloy.

Figure 11:
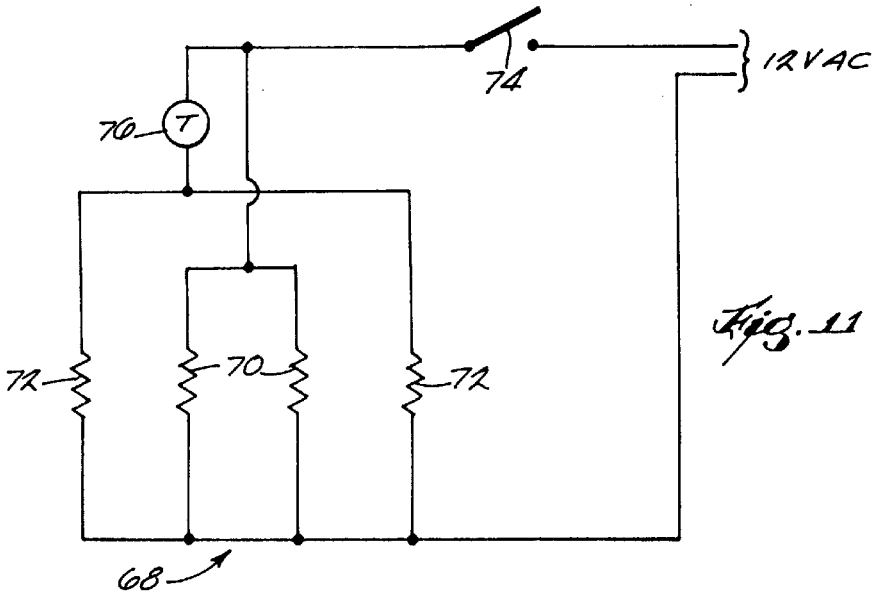
FIG. 11 is a schematic diagram illustrating the wiring of the electrical heating unit shown generally in FIG. 3.

In the illustrated embodiment, the heating unit 22 is a suitable electrical heater 68 capable of maintaining the temperature in the compartment at or above 140° F. As best shown in FIG. 11, the electrical heater 68 includes a pair of continuously operating, electrical resistance heating elements 70 and a pair of intermittently operating, electrical resistance heating elements 72. The continuous heating elements 70 are connected in parallel through a power switch 74 suitably connected to a power supply (not shown), such as a conventional 120 volt AC wall outlet. The power switch 74 is selectively movable between "off" and "on" positions. When the power switch 74 is in the "on" position, the continuous heating elements 70 operate to continuously heat the pan 82 and compartment 47. The intermittent heating elements 72 are connected in parallel through a thermostat 76 and the power switch 74 to the power supply.

The thermostat 76 is mounted in an aperture 78 in the bottom 80 of the pan 82, such that the thermostat 76 directly contacts and senses the temperature of the flexible package 14. The thermostat 76 is operable to cause the intermittent heating elements 72 to operate and heat the pan 82 and compartment 47 when the temperature detected by the thermostat falls below 140° F. The thermostat 76 is also operable to cause the intermittent heating elements 72 to continue to operate and heat the pan 76 and compartment 47 until the temperature detected by the thermostat reaches 159° F. When the temperature detected by the thermostat reaches 159° F., the thermostat 76 is operable to prevent the intermittent heating elements 72 from operating to further heat the pan 76 and compartment 47. When the temperature detected by the thermostat again falls below 140° F., the thermostat 76 causes the intermittent heating elements 72 to operate and heat the pan 76 and compartment 47 until the temperature detected by the thermostat again reaches 159° F. This cycle continues as long as the power switch 74 is in the "on" position. The heater 68 is turned off by moving the power switch 47 to the "off" position. In a preferred embodiment of the invention, the heating elements 70 and 72 are nickel chromium resistance wires coated with mica electrical insulation.

The heater 68 also includes a generally flat, elongated metal housing 84, in which the heating elements 70 and 72 are mounted. The housing 84 includes opposed upper and lower surfaces 86 and 88. The lower surface 88 is mounted on brackets 50 and 52, such that the housing 84 is angled downwardly in the direction toward the housing front wall 36. The upper surface 86 has an aperture (not shown) and the thermostat 76 is disposed in the aperture and extends upwardly therethrough. The thermostat 76 is aligned with an aperture 78 in the bottom 80 of the pan 82 (described below), such that the thermostat 76 extends through the pan aperture 78 for contacting and sensing the temperature of the package 14.

The dispensing valve 26 includes a dispensing portion 100 and an actuating portion 104 operably connected to the dispensing portion 100 for selectively moving the dispensing portion 100 between open and closed positions. As described in further detail below, to facilitate installation and removal of packages, the actuating portion 104 is releasably connected to the dispensing portion 100.

To ensure sanitary dispensing conditions, the entire dispensing portion 100 is disposed inside the compartment 47. The dispensing portion 100 includes a tubular valve body 112 having a continuous sidewall or bore 114 defining an interior flow passage 116. The valve body 112 has an aperture or valve outlet 118 in communication with the flow passage 116 for discharging cheese sauce 12 from the flow passage 116 and package outlet 16. The valve body 112 has a pair of tabs 120, the function of which will be described below. The valve body 112 also has a radially extending flange 122. Because the dispensing portion 100 is disposed entirely inside the temperature conditioned compartment 47 and is maintained at the required temperature by the heater 68, sanitary dispensing conditions are assured. Accordingly, the parts making up the dispensing portion 100 can be constructed from a synthetic thermoplastic or a thermosetting plastic, such as polypropylene, or similar material, instead of more expensive thermal conducting materials such as stainless steel.

The dispensing portion 100 also includes means 123 for removably connecting the valve body 112 to the package outlet 16. Although various suitable means for removably connecting the valve body 112 to the package outlet 16 can be used, in the illustrated embodiment such means includes an internally threaded B-nut 124 for engaging external threads on the package outlet 16. When the B-nut 124 is tightened onto the threads on the package outlet 16, the flange 122 on the valve body 112 is held tightly against the outer end of the package outlet 16 with the flow passage 116 communicating with the package outlet 16.

The dispensing portion 100 also includes a valve member 126 rotatably mounted in the valve body 112 for movement between an open position wherein the cheese sauce 12 can flow from the package outlet 16, through the flow passage 116 and out through the valve outlet 118, and a closed position wherein such flow is prevented. The valve member 126 is a plug rotatably mounted in the valve body bore 114. The valve member 126 includes a continuous sidewall 128 and an inner end wall 130 perpendicular to the sidewall 128. At the intersection of the sidewall 128 and inner end wall 130, the valve member 126 has a notch 132 which is alignable with the valve outlet 118 to connect the valve outlet 118 in communication with the flow passage 116. The notch 132 is aligned with the valve outlet 118 when the valve member 126 is in the open position, and is not aligned with the valve outlet 118 when the valve member 126 is in the closed position. The valve member 126 must be rotated from the closed position to the open position to dispense cheese sauce through the valve outlet 118. The valve member 126 also includes a slot or keyway 134 opposite the inner end wall 130, as further described below.

The actuating portion 104 is operably and releasably connected to the dispensing portion 100 for selectively moving the dispensing portion 100 between open and closed positions. The actuating portion 104 includes a mounting bracket 136 for releasably receiving the valve body 112. The mounting bracket 136 is releasably mounted in the brackets 64 and 66 on the housing bottom wall 46. The mounting bracket 136 includes a horizontal bottom edge portion 138 and a circular aperture 140. The bottom edge portion 138 is dimensioned to be releasably received in the brackets 64 and 66. The aperture 140 is dimensioned to receive the valve body 112 and includes a pair of notches 142 for receiving the tabs 120 and releasably engaging the valve body 112.

Figures 6, 7, 8, 9, 10:
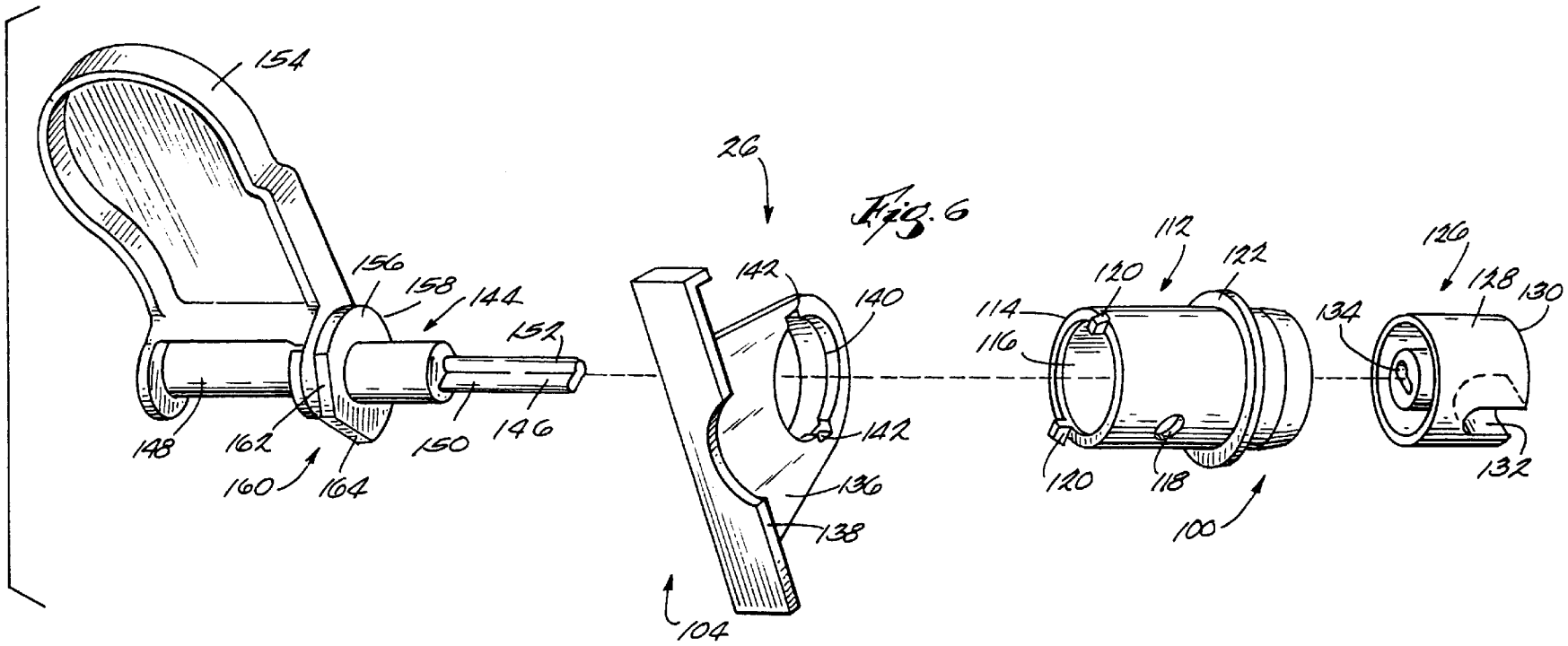
FIG. 6 is an exploded perspective view of the dispensing valve and operating lever shown generally in FIG. 4.
FIG. 7 is a partial sectional view taken generally along line 7—7 in FIG. 3.
FIG. 8 is a partial sectional view taken generally along line 8—8 in FIG. 4.
FIG. 9 is a partial sectional view taken generally along line 9—9 in FIG. 4.
FIG. 10 is a partial sectional view taken generally along line 10—10 in FIG. 3.

The actuating portion 104 also includes an elongated member 144, which extends through the handle notch 56 in the housing bottom wall 46. The elongated member 144 includes opposed inner and outer end portions 146 and 148. The inner end portion 146 is dimensioned to be received in the keyway 134, for releasably and operably connecting the elongated member 144 to the valve member 126. The keyway 134 is a slot having an enlarged head portion. The inner end portion 146 of the elongated member 144 includes a pair of opposed flats 150 depending from a head 152, and is configured to be received in the keyway 134. The outer end portion 148 has a cylindrical outer surface. An operating lever 154 is connected to the outer end portion 148. The elongated member 144 also includes a flange 156 located between intermediate the inner and outer end portions 146 and 148. The flange 156 extends radially outwardly and has a generally circular outer edge 158. The outer edge 158 includes a generally flat cam portion 160 abutting the ledge 58 (FIGS. 7 and 8). The cam portion 160 is slightly V-shaped and a pair of opposed corners 162 and 164 are defined at the intersections of the circular portion with the cam portion 160.

The actuating portion 104 also includes a spiral compression spring 166 (see FIGS. 3, 4, 6, 9 and 10) surrounding the elongated member 144. The compression spring 166 includes opposed inner and outer ends 168 and 170. The inner end 168 (see FIGS. 3, 4 and 10) extends along and rests against one of the flats 150 on the inner end portion 146 of the elongated member 144. The outer end 170 (see FIGS. 3, 4 and 9) extends perpendicularly to the elongated member 144 and is releasably received in the aperture 62 in the ledge 58.

In operation, with the corner 162 of the cam portion 160 engaging the ledge 58 (see FIG. 7) and the operating lever 154 in the horizontal position, the operating lever 154 is depressed (i.e., moved clockwise as viewed in FIG. 3) through an arc of about 35° to rotate the elongated member 144, until the corner 164 engages with the ledge 58 (see FIG. 8) and to stop further rotation. This rotation causes the valve member 126 to move from the closed position (FIG. 3) to the open position (FIG. 4), where the notch 132 is aligned with the valve outlet 118. When the corner 164 engages the ledge 58, the notch 132 is registered or aligned with the valve outlet 118, and the cheese sauce flows out of the valve outlet 118 until the operating lever 154 is released by the user. When the operating lever 154 is released, the spring 166 causes the elongated member 144 to rotate in the opposite direction until the corner 162 engages the ledge 58. This rotation returns the operating lever 154 to the horizontal position and the valve member 126 to the closed position. The corner 162 engaging the ledge 58 also prevents the operating lever 154 from being moved in the counterclockwise direction beyond the horizontal position.

The dispensing outlet 28 is located so that cheese sauce 12 exiting from the valve outlet 118 is discharged therethrough. The dispensing outlet 28 is located directly beneath the valve outlet 118 and, to ensure sanitary operation, is sized so that cheese sauce 12 being discharged through the dispensing outlet 28 will not contact any part of the bottom wall 46. If desired, the dispensing outlet 28 may include a tube or fitting (not shown) for directing the flow of the cheese sauce 12. If such a tube or fitting is located entirely within the compartment 47, it may be constructed of plastic or similar material and still provide sanitary operation. However, if a portion of such a tube or fitting is located outside the compartment 47, that portion must be constructed of thermally conductive material such as stainless steel in order to ensure sanitary operation.

The dispensing device 10 preferably includes means 164 for applying a downward force on the package 14 to promote flow of the cheese sauce 12 toward and through the package outlet 16. In the illustrated embodiment, a weight 166 resting on top of the package 14 is used for this purpose. The weight 166 preferably is another flexible package containing cheese sauce and identical to the package 14 from which cheese sauce is being dispensed. In addition to serving as a weight for promoting flow of cheese sauce 12 from the package 14, the cheese sauce 12 in the second package is preheated to the desired temperature level for dispensing, e.g., at least 140° F. Thus, when the package 14 is emptied, the second package is removed, the empty package 14 and dispensing portion 100 of the valve 26 are removed, the dispensing portion 100 of the valve 26 is removed from the empty package 14 and connected to the second package, and the second package is installed in the pan 82 with the dispensing portion 100 extending through the slot 104. After another unheated package of cheese sauce is placed on top of the second package (now denoted as package 14), and the lid 48 is replaced, dispensing can be started without preheating or cleaning the dispensing portion 100 of the valve 26, because both the package 14 and dispensing portion 100 have been maintained at the required temperature.

In use, when a package 14 of cheese sauce is emptied and must be removed, the lid 48 is first removed to expose the compartment 47. The mounting bracket 136 is released from the brackets 64 and 66 in the housing bottom wall 46, the outer end portion 148 of the elongated member 144 is removed from the handle notch 56 in the housing bottom wall 46 (thereby also removing the outer end 170 of the spring 166 from the aperture 62 in the ledge 58), and the inner end portion 146 of the elongated member 144 is removed from the keyway 134 of the valve member 126. Next, the tabs 120 on the valve body 112 are removed from the notches 142 in the mounting bracket 136, such that the mounting bracket 136 is released from the valve body 112. Then, the package 14 and the dispensing portion 100 of the valve 26 are removed as a single unit from the pan 82. The B-nut 124 is unthreaded, and the dispensing portion 100 is removed from the package outlet 16 of the empty package 14. The empty package is discarded.

The dispensing portion 100 of the valve 26 is connected to the package outlet 16 of a new package 14 prior to placement of the package 14 in the pan 82. To accomplish this, the valve body 112 is inserted into the package outlet 16, and the B-nut 124 is threaded onto the threads on the package outlet 16 to connect the valve body 112 thereto. The package 14 is placed in the pan 82 with the package outlet 16 and the dispensing portion 100 of the valve 26 extending out of the slot 104 in the pan 82. The valve body 112 is inserted into the aperture 140 in the mounting bracket 136 with the tabs 120 received in the notches 142. The inner end portion 146 of the elongated member 144 is inserted into the keyway 134 of the valve member 126, and the elongated member 144 is rotated in a clockwise direction as viewed in FIG. 3 until the corner 162 of the cam portion 160 of the flange 156 is aligned to engage the ledge 58 (i.e., until the valve member 126 is in the closed position). The bottom edge portion 138 of the mounting bracket 136 is inserted into the brackets 64 and 66 in the housing bottom wall 46, and the outer end portion 148 of the elongated member 144 is positioned in the handle notch 56 in the housing bottom wall 46 with the corner 162 of the cam portion 160 of the flange 156 engaging the ledge 58 and the operating lever 154 in the horizontal position. The outer end 170 of the spring 166 is inserted into the aperture 62 in the ledge 58. A new, unopened package is placed in the pan 82 atop the package 14, and the lid 48 is replaced, so that the dispenser 10 is ready for operation to dispense cheese sauce 12.

FIGS. 12–19 illustrate an alternate embodiment including a package support, dispensing valve and heating unit having different arrangements. Parts which are the same or similar to those illustrated in FIGS. 1–11 are assigned common reference numerals.

Figures 10, 11, 12, 22:
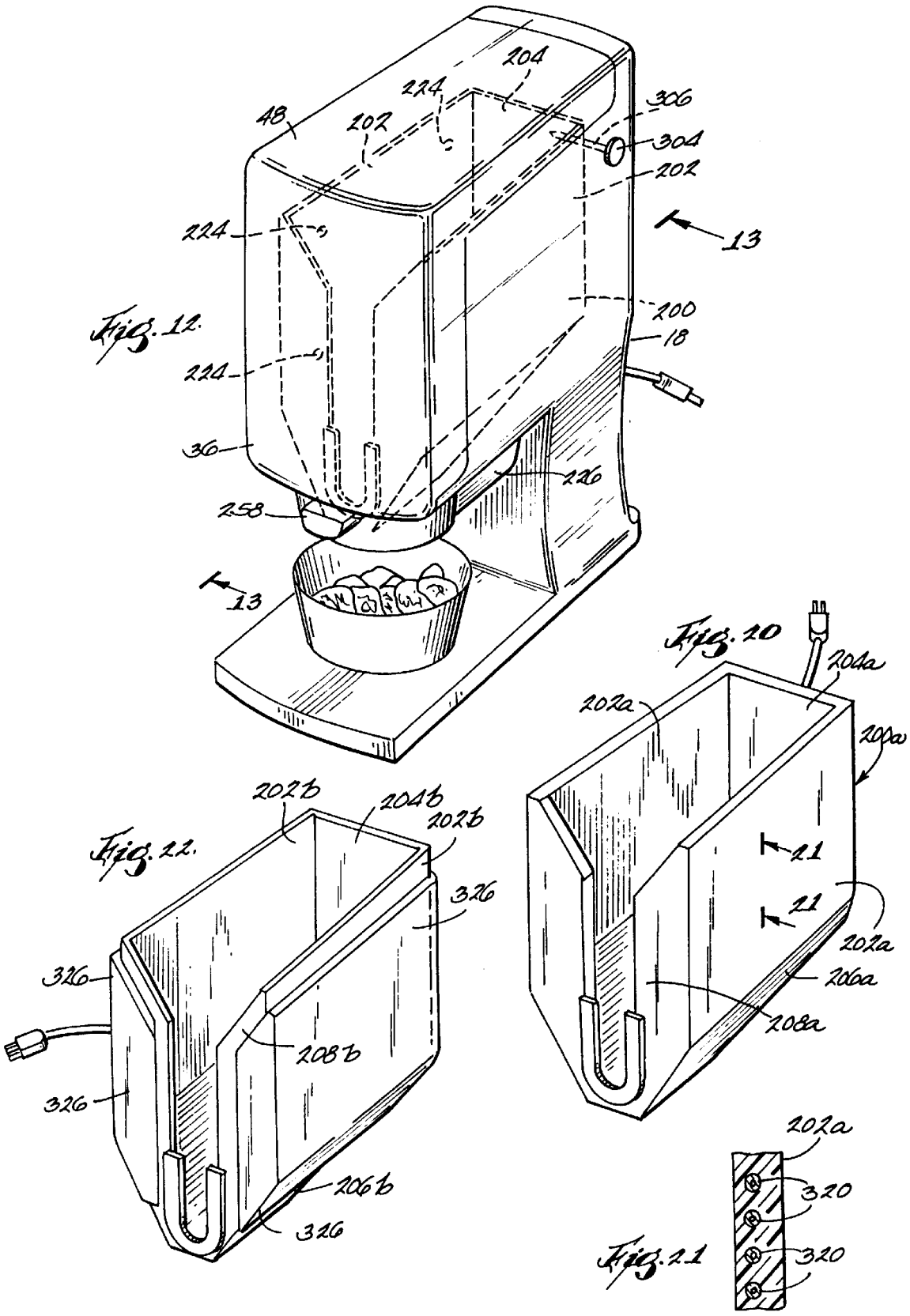
FIG. 12 is a perspective view of an alternate embodiment of the dispensing device including a hopper in which a package is stored for dispensing.
FIG. 22 is a perspective view of an alternate arrangement for the hopper.
Figure 13:
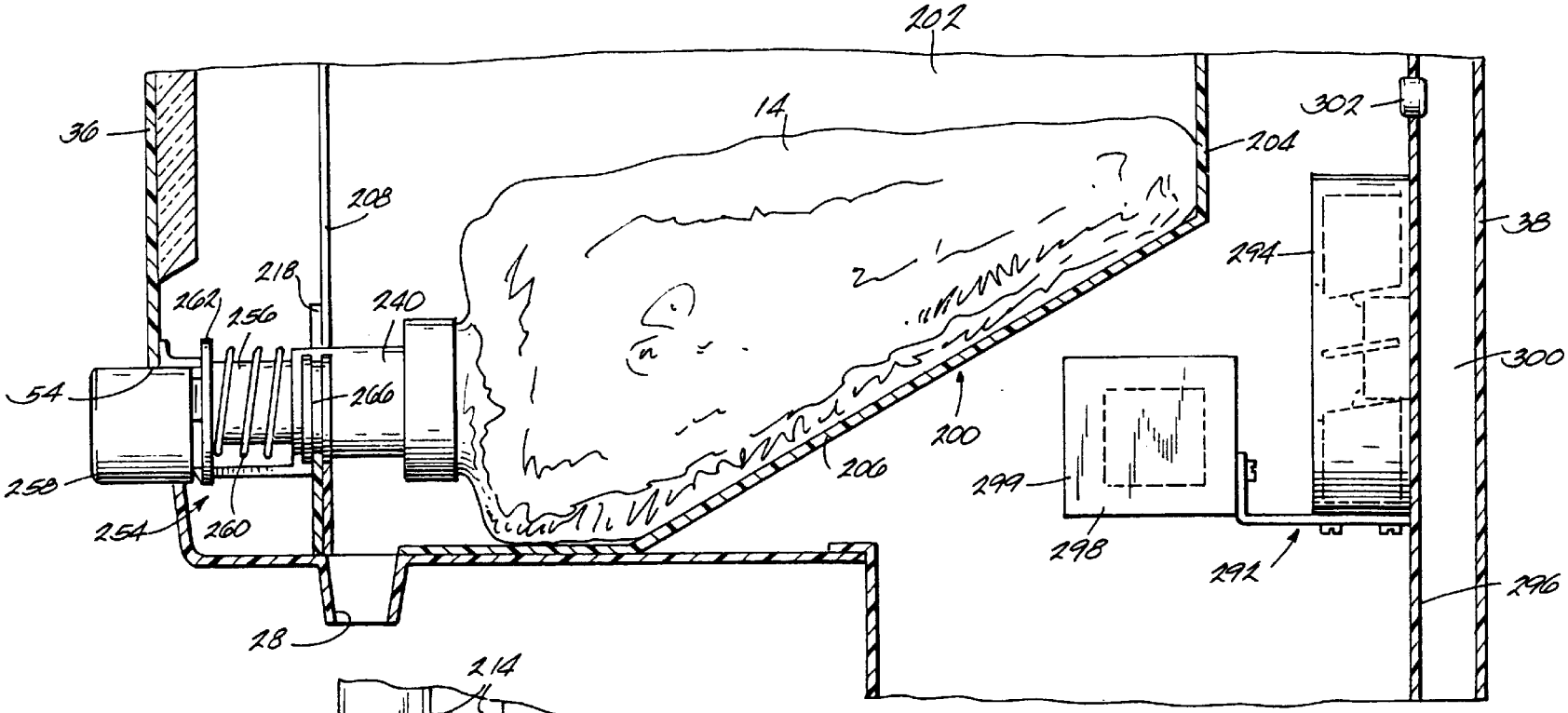
FIG. 13 is an enlarged sectional view taken generally along line 13—13 in FIG. 12.
Figure 14:
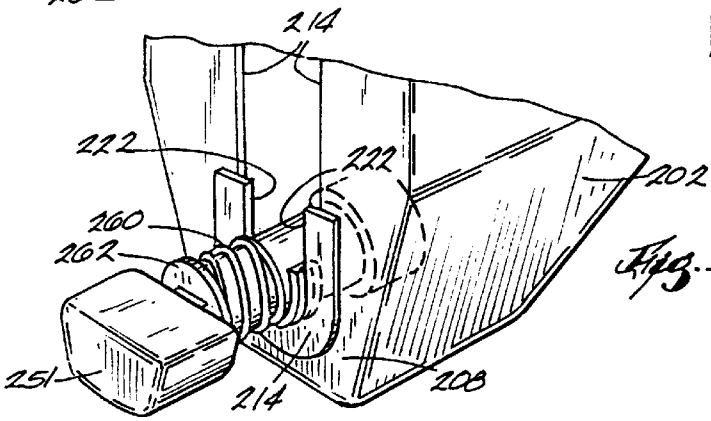
FIG. 14 is a fragmentary perspective view of the lower front end portion of the storage hopper with the valve installed on a package and the hopper.

Referring to FIGS. 12–14, the housing 18 is constructed in substantially the same manner as described above. In place of a pan including several parts which must be welded or otherwise joined together, the package support is a hopper 200 formed from a suitable thermoplastic or thermosetting synthetic plastic material, such as a polycarbonate or fiberglass, and preferably is formed as a one-piece unit. The hopper 200 has opposed sidewalls 202, a rear wall 204, a forwardly inclined bottom wall 206 for promoting gravity flow of cheese sauce from a package 14 and a front wall 208. The front wall 208 has a V-shaped opening 210 for facilitating installation and removal of packages 14. The opening 210 has a U-shaped lower portion 212.

Because of a build up of manufacturing tolerances, it can be difficult to maintain the dimension between the opposed vertical edges 214 of the opening lower portion 212 and the thickness of the hopper front wall 208 in the vicinity of the opening lower portion 212 within ranges of tolerances required to facilitate installation of a dispensing valve 216 as described below. A separate plate 218 suitably fastened to the outer surface of the front wall 208 by an adhesive or the like, in the vicinity of the opening lower portion 212 is used to minimize tolerance problems. As best shown in FIGS. 14 and 17, the plate 218 has a U-shaped opening 220 including opposed vertical edges 222 which extend a short distance beyond the vertical edges 214 of the opening lower portion 212 and slidably receive a dispensing valve 220 to hold it in place as described in more detail below. The plate 218 preferably is made from a suitable thermoplastic or thermosetting synthetic plastic material.

The hopper 200 (FIGS. 12 and 16) is suitably attached to the housing side walls 40 and 42 of the housing 18, such as by bolts 224 which thread into threaded bosses 227 on the inner surface of the housing side walls 40 and 42. A one-piece plastic hopper is advantageous because it reduces fabrication costs and the walls do not get as hot as is the case with a metal pan.

A valve guard 226 (FIGS. 13, 15 and 16), removably mounted on the lower front portion of the housing 18, cooperates with the housing side walls 40 and 42 to form a front portion 228 of the housing bottom wall 230. The valve guard 226 is arranged in substantially the same manner as the front portion of the housing bottom wall 46 described above. The brackets 64 and 66 and aperture 62 described above are omitted and the valve guard 226 includes a dispensing outlet 28 and a notch 56 in the upper edge portion 54 through which the outer portion of the dispensing valve 216 extends as described below.

The housing side walls 40 and 42 have opposed elongated guides 232. Each guide 232 has an elongated guideway 234 which is open at one side and extends parallel to the respective side wall 40 and 42. The valve guard 226 includes opposed elongated ribs 236 which fit into and slide along the guideways 234 to permit only longitudinal of the valve guard 226 relative to the housing 18.

As best shown in FIG. 15, the front wall 208 of the hopper 200 extends beyond the dispensing outlet 28 in the valve guard 226 and the hopper bottom wall 206 includes an opening 238 which is aligned with the dispensing outlet 28 when the valve guard 226 is in place.

The dispensing valve 216 (FIGS. 15 and 19) includes a tubular sleeve or body 240 having a bore 242 and an actuating portion 244 carrying a cylindrical valve member 246 slidably mounted in the valve body bore 242. The valve member 246 has an elongated internal cavity 248 including a port 250 and is movable axially relative to the valve body 240 between an open position where the port 250 is aligned with a valve outlet 252 in the valve body 240 and a closed position where the port 250 is moved away from the valve outlet 252 and the valve member 246 completely covers the valve outlet 252.

The actuating portion 246 of the dispensing valve includes an outer end portion 254 which extends through the notch 56 in the valve guard 226 and an intermediate portion 256 between the valve member 246 and the outer end portion 254. In the specific embodiment illustrated, the actuating portion 246, (including the outer end portion 254 and the intermediate portion 256) and the valve member 246 are formed as a one-piece subassembly. Mounted on the outer end portion 254 and accessible from outside the front wall 36 of the housing 18 is a knob 258 which an operator pushes to move the valve member 246 to the open position.

Suitable means are provided for biasing the valve member 246 toward the closed position. In the embodiment illustrated in FIGS. 12–21, the valve member 246 is biased toward the closed position by a coil spring 260 encircling the intermediate portion 256 of the actuating portion 244 with one end 256 bearing against the front end of the valve body 240 and the other end bearing against a circumferentially extending spring retainer 262 extending radially outwardly from the intermediate portion 256. The valve body 240 is removably connected to a package outlet 16 by a B-nut 24 as described above.

The dispensing valve 216 preferably is removably mounted on the hopper front wall 208 in a suitable manner. In the embodiment illustrated in FIGS. 12–21, the outer or front end 264 of the valve body 240 includes diametrically opposed slots 266 which fit relatively snugly over the vertical edge 222 of the U-shaped plate 218 on the outer surface of the hopper front wall 208 to hold the dispensing valve 216 in place. More specifically, the valve body 240 includes a circumferentially ending, raised rib 268, on the outer surface which extends through about 110° around the valve body 240 and the slots 266 are part of one continuous groove in the rib 268.

As best shown in FIG. 13, after the dispensing valve 216 has been installed on the hopper front wall 208, substantially the entire valve body 240 and substantially the entire valve member 246 are located inside the hopper 200. The valve body 240 and the actuation portion 244 of the dispensing valve 216 preferably are releasably connected together so that the valve body 240, the B-nut 24, the spring 260 and the actuation portion 244 can be conveniently separated for cleaning. In the specific construction illustrated, the valve body 240 includes a deflectable finger or clip 270 extending axially from the front end 264 of the valve body 240 toward the knob 258. The clip 270 has an elongated body 272 and an enlarged outer end 274 having a ramp 276 including a camming surface 278 upwardly downwardly in a direction toward the valve body 240 and terminating in a radially inwardly extending shoulder 280.

The spring retainer 262 has an arcuate slot 282 arranged to receive the outer end 294 of the clip 270 and cooperate therewith to releasably hold the valve body 240 and the actuating portion 244 together. One end of the slot 282 includes a larger offset portion 284, corresponding to the unlocked position of the clip 270, which is dimensioned to received the enlarged outer end 274 of the clip 270 and permit axial movement of the clip 270 relative to the spring retainer 262 when the clip 270 is in a deflected position. The opposite end of the slot 282 includes a smaller offset portion 286, corresponding to the locked position of the clip 270, which receives the body 272 of the clip 270. The smaller offset portion 286 is dimensioned so that, when the clip 270 is in an undeflected or released position, there can be no appreciable relative rotational movement of the valve body 240 and knob 258 and the valve body 240 cannot be moved appreciably in an axial direction away from the spring retainer 262. The knob 258 includes an elongated a slot 288 for receiving the outer end portion 274 of the clip 270 so that the knob 258 and the actuating portion 244 can be moved axially inwardly toward the valve body 240 far enough for the port 250 to be aligned with the valve outlet 252.

For assembly of the dispensing valve 216, the spring 260 is slipped over the intermediate portion 256 of the actuation portion 244 after the knob 258 has been installed and the B-ring 24 is slipped over the clip 270 and the valve body 240. After the clip 270 is aligned with the larger offset 284 in the spring retainer slot 282, the valve body 240 and actuator portion 244 are moved toward each other. As the camming surface 278 on the clip ramp 276 rides against the upper edge of the larger offset 284, the outer end 274 of the clip 270 is deflected and, after the camming surface 278 has moved past the upper edge of the larger offset 284, the clip 270 returns toward an undeflected position. After the clip 270 is deflected to move the clip body 272 out of the larger offset 284, the knob 258 and valve body 240 are rotated relative to each other (i.e., as viewed in FIG. 18, the knob 258 is rotated clockwise relative to the valve body 240) until the clip body 272 is moved into the smaller offset 286.

The lower edge 290 of the smaller offset 286 is below the lower edge 292 of the slot 282 so the clip 270 returns towards an undeflected or locked position when released after being fully received in the smaller offset 286. When the clip 270 is in such a locked position, the shoulder 280 engages the front surface of the spring retainer 262 to prevent the valve body 240 from being separated from the actuation portion 244. The smaller offset 286 has a width slightly larger than the width of the clip body 272, thereby preventing relative rotation of the valve body 240 and the actuation portion 244 as long as the clip 270 is in such an undeflected.

The assembled dispensing valve 216 can be installed on a package as described above, the package placed in the hopper 200, the valve body 244 installed in the hopper opening 200 as described above and the valve guard 226 installed. If the package has been preheated to a temperature above 140° F., the dispenser is ready for use.

Figure 19:
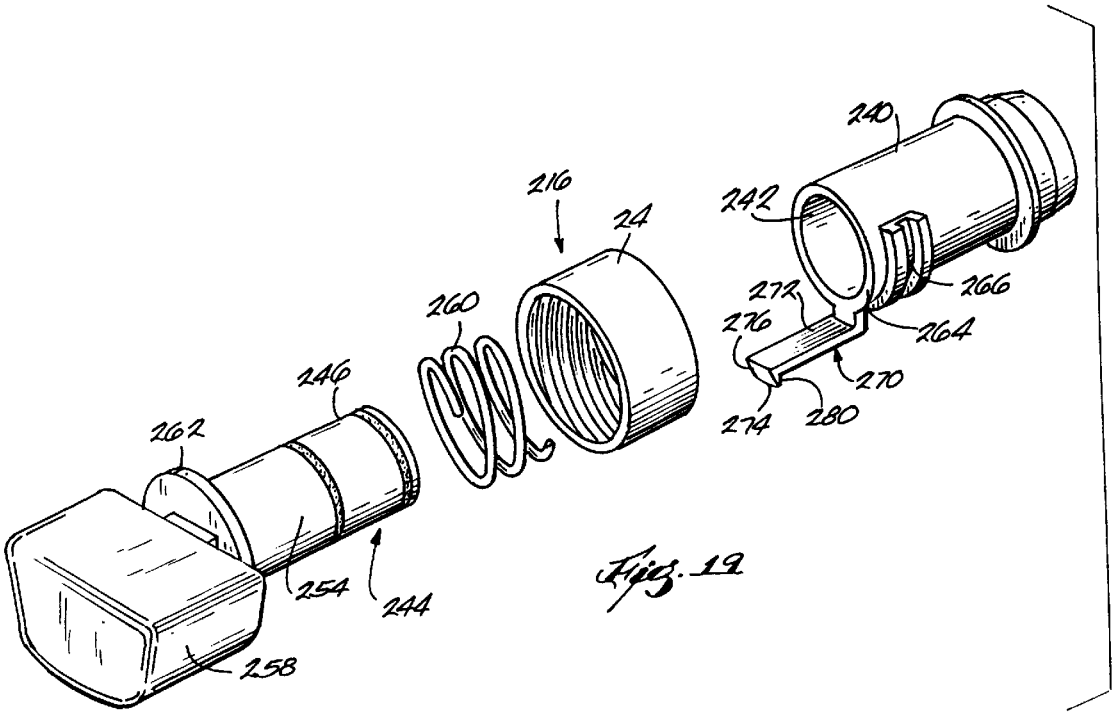
FIG. 19 is an enlarged, exploded perspective view of the dispensing valve.

When it is desired to separate the parts of the dispensing valve for cleaning, the clip 270 is deflected downwardly until the clip body 272 is removed from the smaller offset 286, the knob 258 and the valve body 240 are rotated relative to each other (i.e., as viewed in FIG. 18, the knob 258 is rotated counterclockwise) until the clip body 272 reaches the larger offset 284. While the clip 270 is still deflected, the outer end 274 can be withdrawn through the larger offset 284 and the valve body 240 separated from the actuation portion 244, the B-nut 24 slipped off the valve body 240, the spring 260 slipped off the intermediate portion 254 as shown in FIG. 19 and all these parts can be cleaned in a suitable manner, such as by washing in warm soapy water.

In the embodiments illustrated in FIGS. 12–19, the heating unit 292 (FIG. 13) consists of a conventional electric fan 294 mounted on a baffle 296 spaced inwardly from and extending generally parallel to the housing rear wall 38 and a conventional electric heater 298 having external fins 299 located in front of the fan 294.

The inlet side of the fan 298 is open to the space 300 between the baffle 296 and the housing rear wall 38 and blows air over the heater fins 299. Air circulates beneath the hopper 200, upwardly in front of the hopper front wall 208, over the top of the package 14 and back into the space 300.

A conventional thermostat 302 mounted in an aperture in the baffle 296 controls the operation of the fan 294 and the heater 298 to maintain the temperature inside the hopper 200 at or above 140° F. Temperature inside the housing 18 can be monitored by a conventional thermometer 304 mounted in a housing side wall with the sensing portion 306 extending into the top portion of the space 300.

FIGS. 20 and 21 illustrate a hopper 200*a* employing an alternate means for heating packages. In this embodiment, conventional electrical heating elements 320, such as Mylar, silicone or polymer heating elements, are incorporated into the rear wall 204*a*, side walls 202*a*, bottom wall 206*a* and front wall 208*a* at the time the hopper 200*a* is formed. Operation of the heating elements 34 is controlled by a conventional thermostat as described above. Such an arrangement is particularly advantageous because it does not require moving parts and the hopper walls are not as hot as the walls of the metal pan.

FIG. 22 illustrate a hopper 200*b* employing another alternate means for heating packages. In this embodiment, conventional electric blanket heaters 326 are attached to the rear wall 204*b*, side walls 202*b*, bottom wall 206*b* and front wall 208*b* of the hopper 200*b*. The blanket heaters can be attached to either the exterior surfaces of the hopper walls as illustrated, to the interior surfaces of the hopper walls or some to exterior surfaces and others to interior surfaces.

When gallon size packages are lying flat, the side walls are approximately 2½ to 3 inches apart. When such a package is placed on edge in a pan or hopper for dispensing, the side walls tend to bulge and the package assumes a generally oblong cross sectional shape with the side walls being as much as 7 to 10 inches apart. ANSI/NSF 18-1990, the NSF standard for manual food and beverage dispensing equipment, requires that the storage compartment for low acid food product to be capable of maintaining the food product at a minimum temperature of 140° F. ANSI/NSF 4-1992, the standard for commercial rethermalization, requires that potentially hazardous food products having a pH level of 4.6 or less to be rethermalized, i.e., heated from a refrigerated or ambient state to an elevated temperature of not less than 165° F., must be capable of heating the food product to that temperature within two hours. All the embodiments described above are capable of maintaining a package of cheese sauce at a minimum temperature of 140° F. once the package has been heated to that temperature. However, without employing more expensive and complex heating means, it may be difficult to meet the ANSI/NSF 4-1992 standard for rethermalization because of the cross sectional shape of a package. For such situations, the package to be dispensed can be preheated to the desired predetermined temperature, such as in an electric frying pan or the like, and then installed.

Figure 23:
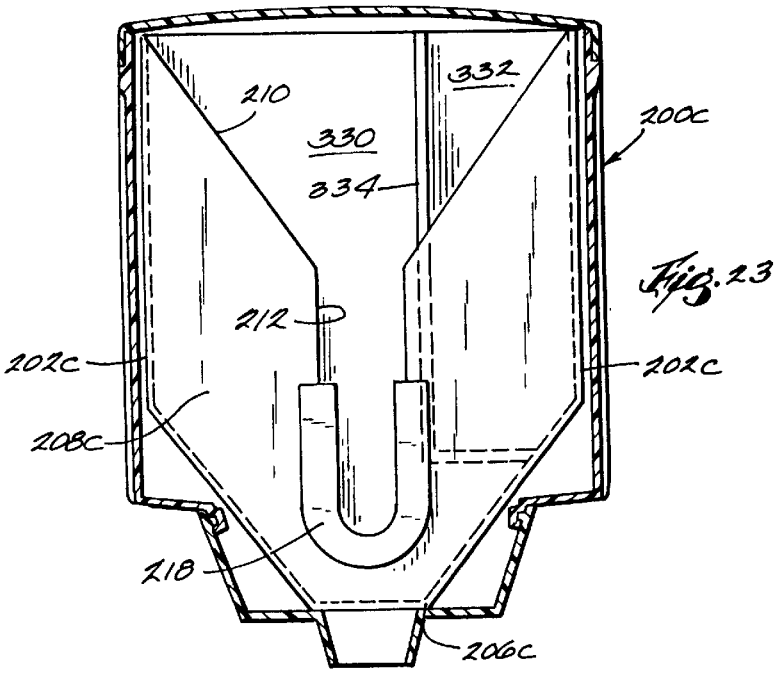
FIG. 23 is a cross sectional front view of hopper arranged for both dispensing and preheating a packages.

FIG. 23 illustrates a hopper 200*a* arranged in a manner so that the dispenser can be used as a preheater. In this embodiment, the hopper 200*a* is divided into a preheating compartment 330 and a dispensing compartment 332 by a partition 334. The width of the preheating compartment 332 is dimensioned to hold the side walls of a package close enough together to permit more rapid heating of the cheese sauce. For example, the width of the preheating compartment 332 can be about 2 to 3 inches for one gallon size packages.

The preheating compartment 332 has a bottom wall 336 spaced upwardly from the hopper bottom wall 206*c* to define an open space 338 below the preheating compartment 332 into which a package located in the dispensing compartment 330 can spread out for dispensing when a second package is placed on top of the first package. The hopper 200*c* otherwise can be arranged in the same manner as described above, including a V-shaped opening 210 in the front wall 208*c* having a U-shaped lower portion 212 and a U-shaped plate 218 for receiving the dispensing valve body.

During start up, a package is placed in the preheating compartment 332 at least two hours before dispensing is to start and one or more packages placed in the dispensing compartment 330. The package in the preheating compartment 332 is then removed, a dispensing valve installed on the preheated package, the package/dispensing valve placed in the dispensing compartment 330 and the dispensing valve mounted on the hopper front wall 208*c* as described above. A second package from the dispensing compartment 330 (which is at least partially preheated to 140° F. or above) is placed on top of the preheated package, the valve guard 226 and lid 48 installed and the dispenser is ready for dispensing. Since both the second and third packages will be heated to 140° F. or above, while material is being dispensed from the preheated or first package, either can be used for dispensing after the first package is emptied without preheating. A third package, either from the dispensing compartment 330 or from normal storage, can be placed in the preheating compartment, if desired.

The partition 334 preferably includes heating means, such as an electric blanket heater attached to one or both of the opposed surfaces or electrical heating elements molded in as an integral part of the partition as described above.

The dispensing device is adaptable for dispensing cheese sauce or other heated flowable materials from containers other than the type packages described above. For example, ordinary plastic pouches can be modified for use in the dispensing device by heat welding an outlet fitment arranged to receive the valve body and B-nut on the outer surface of the pouch near one corner prior to filling the pouch with cheese sauce or other flowable material. The pouch can be pierced through the fitment just prior to installation on a dispensing valve in a manner to permit the cheese sauce or other heated flowable material to thereafter flow freely through the fitment under the influence of gravity.

From the forgoing description, one skilled in the art can easily ascertain the essential characteristics of the invention and, without departing from the spirit and scope thereof, make various changes and modifications to adapt it to various usages.

What is claimed is:

1. A combination for dispensing a flowable food product, said combination comprising:

a flexible package having an outlet and containing the food product, wherein the food product is to be maintained at or above a predetermined temperature level after said package is initially opened; and a dispensing device including a housing including opposed walls cooperating to define a compartment for holding at least one of said packages, a heating unit for maintaining said compartment at or above the predetermined temperature level, means for supporting said package in said compartment at an orientation promoting gravity flow of the food product toward and through said package outlet, a valve for selectively controlling flow of the food product from said package, said valve including a dispensing portion and an actuating portion, said dispensing portion being disposed entirely within said compartment and heated by said heating unit, said dispensing portion including a valve body having a flow passage, a valve outlet communicable with said flow passage, and a valve member mounted in said valve body for movement between an open position, in which the food product can flow from said package, through said flow passage and out through said valve outlet, and a closed portion to prevent such flow, said actuating portion being operably connected to said valve member for movement of said valve member between the open and closed positions, means for removably connecting said valve body to said package outlet with said flow passage in communication with said package outlet, and a dispensing outlet in one of said housing walls through which the food product flowing through said valve outlet is discharged from said compartment, wherein said actuating portion includes an elongated member having an outer end portion and an inner end portion operably connected to said valve member, means connected to the outer end portion of said elongated member and accessible from outside said compartment for moving said valve member from the closed position to the open position, and means for biasing said valve member toward the closed position, wherein said valve member further includes an outer end having a keyway, and wherein the inner end portion of said elongated member is releasably and operably received in said keyway.

2. A combination for dispensing a flowable food product, said combination comprising:

a flexible package having an outlet and containing the food product, wherein the food product is to be maintained at or above a predetermined temperature level after said package is initially opened; and a dispensing device including a housing including opposed walls cooperating to define a compartment for holding at least one of said packages, a heating unit for maintaining said compartment at or above the predetermined temperature level, means for supporting said package in said compartment at an orientation promoting gravity flow of the food product toward and through said package outlet, a valve for selectively controlling flow of the food product from said package, said valve including a dispensing portion and an actuating portion, said dispensing portion being disposed entirely within said compartment and heated by said heating unit, said dispensing portion including a valve body having a flow passage, a valve outlet communicable with said flow passage, and a valve member mounted in said valve body for movement between an open position, in which the food product can flow from said package, through said flow passage and out through said valve outlet, and a closed portion to prevent such flow, said actuating portion being operably connected to said valve member for movement of said valve member between the open and closed positions, means for removably connecting said valve body to said package outlet with said flow passage in communication with said package outlet, and a dispensing outlet in one of said housing walls through which the food product flowing through said valve outlet is discharged from said compartment, wherein said valve body includes a bore defining said flow passage, wherein said valve member includes a port and is mounted in said bore for reciprocal axial movement relative to said valve body between an open position, in which said port is aligned with said valve outlet to connect said valve outlet in communication with said flow passage, and a closed position, in which said valve outlet is covered, wherein said actuating portion includes an actuating meter having an outer end portion and an inner end portion connected to said valve, means connected to the outer end portion of said actuating member and accessible from outside said housing for moving said valve member from the closed position to the open positions and means for biasing said valve member toward the closed position, wherein said actuating portion has an outer surface, wherein said valve member and said actuating portion are connected to form a subassembly, wherein said dispensing valve includes means for removably connecting said valve body to said subassembly, and wherein said means for removably connecting said valve body to said subassembly includes a deflectable finger and a retainer, said finger being connected to said valve body and extending axially outwardly from said valve body in a direction toward the outer end portion of said actuating portion, said finger having an elongated body and an outer end terminating in an enlarged portion, said retainer being on said actuating portion, extending radially outwardly therefrom and including an arcuate, circumferentially extending slot for receiving the outer end of said finger, said slot including first and second offset portions, wherein, when said valve body and said subassembly are rotated relative to each other to an unlocking position, said first offset portion permits relative axial movement of said valve body and said subassembly such that the enlarged outer end portion of said finger can be roved through and withdrawn from said first offset portion, said second offset portion being circumferentially spaced from said first offset portion and receiving the body of said finger, wherein, when said valve body and said subassembly are in a locked position, said second offset portion prevents the enlarged outer end portion of said finger from being withdrawn through said second offset portion and prevents said valve body and said subassembly from being rotated relative to each other without said finger being deflected.

3. A combination for dispensing a flowable food product, said combination comprising:

a flexible package having an outlet and containing the food product, wherein the food product is to be maintained at or above a predetermined temperature level after said package is initially opened; and a dispensing device including a housing including opposed walls cooperating to define a compartment for holding at least one of said packages, a heating unit for maintaining said compartment at or above the predetermined temperature level, means for supporting said package in said compartment at an orientation promoting gravity flow of the food product toward and through said package outlet, a valve for selectively controlling flow of the food product from said package, said valve including a dispensing portion and an actuating portion, said dispensing portion being disposed entirely within said compartment and heated by said heating unit, said dispensing portion including a valve body having a flow passage, a valve outlet communicable with said flow passage, and a valve meter mounted in said valve body for movement between an open position, in which the food product can flow from said package, through said flow passage and out through said valve outlet, and a closed portion to prevent such flow, said actuating portion being operably connected to said valve member for movement of said valve member between the open and closed positions, means for removably connecting said valve body to said package outlet with said flow passage in communication with said package outlet, and a dispensing outlet in one of said housing walls through which the food product flowing through said valve outlet is discharged from said compartment, wherein said package support comprises a hopper molded from a synthetic thermoplastic or thermosetting material and having a bottom wall outwardly inclined toward said dispensing valve for supporting the package in an orientation for promoting gravity flow of the food product through the package outlet, wherein said hopper includes a front wall having an opening including a lower portion, wherein said dispensing device further includes mounting means on said valve body and said hopper front wall for removably mounting said valve body in the lower portion of said opening with said valve body and said valve member located substantially entirely inside said hopper, wherein said valve body has an exterior surface, and wherein said mounting means includes opposed, generally vertically extending edges defining a portion of the lower end of said opening and opposed slots in the exterior of said valve body for slidably receiving said edges.

4. The dispensing device according to claim 3 wherein said package has side walls which tend to bulge outwardly when the package is positioned in said package support for dispensing; and said hopper includes a partition extending generally parallel to the hopper side walls and cooperating therewith to define a dispensing compartment for holding a package for dispensing and a preheating compartment for holding at least one of said packages for preheating, said partition being spaced from one of said side walls at a dimension which provides a width small enough to prevent substantial bulging of the side walls of a package located therein with the side walls of the said package abutting said partition and said one side wall, thereby maintaining the thickness of the food product mass at a dimension which permits the food product to be heated to the predetermined temperature within a substantially shortened time period than would be the case if the package side walls were allowed to bulge naturally.

* * * * *